US009211987B2

(12) United States Patent
James et al.

(10) Patent No.: US 9,211,987 B2
(45) Date of Patent: Dec. 15, 2015

(54) FLEXIBLE POUCH AND DOCK SYSTEM

(71) Applicant: Dow Global Technologies LLC, Midland, MI (US)

(72) Inventors: Timothy James, Brooklyn, NY (US); Haley A. Lowry, Houston, TX (US); Jill M. Martin, Brazoria, TX (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 13/971,551

(22) Filed: Aug. 20, 2013

(65) Prior Publication Data

US 2014/0231453 A1 Aug. 21, 2014

Related U.S. Application Data

(63) Continuation-in-part of application No. 29/446,105, filed on Feb. 20, 2013, which is a continuation-in-part of application No. 29/446,120, filed on Feb. 20, 2013.

(51) Int. Cl.

| | |
|---|---|
| ***B65D 35/56*** | (2006.01) |
| ***B65D 75/00*** | (2006.01) |
| ***B65D 47/30*** | (2006.01) |

(52) U.S. Cl.

CPC ..... *B65D 75/008* (2013.01); *B65D 47/305* (2013.01)

(58) Field of Classification Search

CPC ..... B65D 35/28; B65D 35/00; B65D 35/56; B65D 75/008; B65D 47/305

USPC ..... 222/554, 92, 93, 105–107, 183, 222/533–536, 103, 181.2, 181.1

See application file for complete search history.

(56) References Cited

U.S. PATENT DOCUMENTS

| | | | | | |
|---|---|---|---|---|---|
| 3,161,326 | A | * | 12/1964 | Parr | 222/183 |
| 3,374,928 | A | * | 3/1968 | Hope | 222/105 |
| D243,121 | S | | 1/1977 | Ralston, Jr. et al. | |
| 4,331,266 | A | * | 5/1982 | Bond | 222/107 |
| 4,416,395 | A | * | 11/1983 | Gaubert | 222/83 |
| D304,546 | S | | 11/1989 | Cattach | |
| 4,969,580 | A | | 11/1990 | Mikhail Ezzat A | |
| 4,974,762 | A | | 12/1990 | Boretsky et al. | |
| 5,307,955 | A | | 5/1994 | Viegas | |
| D360,824 | S | | 8/1995 | Ossendryver | |
| 5,579,945 | A | | 12/1996 | Ichikawa et al. | |
| 5,879,768 | A | * | 3/1999 | Falla et al. | 428/35.7 |
| 6,021,928 | A | * | 2/2000 | Falconer | 222/554 |

(Continued)

FOREIGN PATENT DOCUMENTS

| | | | |
|---|---|---|---|
| EP | 0371307 | A1 | 11/1989 |
| JP | H0741010 | A | 2/1995 |

(Continued)

OTHER PUBLICATIONS

Machine translation of JP2000335594.

(Continued)

*Primary Examiner* — Kevin P Shaver
*Assistant Examiner* — Robert Nichols, II
(74) *Attorney, Agent, or Firm* — Whyte Hirschboeck Dudek S.C.

(57) ABSTRACT

The present disclosure provides a flexible pouch for bottom-dispensing a liquid. A dock for holding the flexible pouch is also provided. Further disclosed herein is a system for dispensing a liquid. The system includes the pouch for placement in the dock.

19 Claims, 11 Drawing Sheets

(56) References Cited

U.S. PATENT DOCUMENTS

| | | | | |
|---|---|---|---|---|
| 6,056,157 | A * | 5/2000 | Gehl et al. | 222/94 |
| D447,694 | S | 9/2001 | Leggett | |
| 6,705,492 | B2 | 3/2004 | Lowry | |
| 6,880,728 | B1 | 4/2005 | Moisio et al. | |
| 6,895,729 | B2 | 5/2005 | Post et al. | |
| 7,261,221 | B2 | 8/2007 | Awbrey et al. | |
| D573,897 | S | 7/2008 | Berman | |
| D587,122 | S | 2/2009 | Herstol et al. | |
| 7,544,191 | B2 * | 6/2009 | Peluso et al. | 604/414 |
| D603,957 | S | 11/2009 | Sato et al. | |
| D609,101 | S | 2/2010 | Herstol et al. | |
| D626,857 | S | 11/2010 | Spanjaard | |
| D631,363 | S | 1/2011 | Herstol et al. | |
| 7,874,466 | B2 | 1/2011 | McConville et al. | |
| 8,225,958 | B2 * | 7/2012 | Nielsen et al. | 220/720 |
| 8,276,806 | B2 * | 10/2012 | Burke | 229/117.3 |
| D680,880 | S | 4/2013 | Johnson et al. | |
| 8,408,790 | B2 * | 4/2013 | Reilly | 383/41 |
| 2003/0015556 | A1 * | 1/2003 | Wild et al. | 222/534 |
| 2003/0192909 | A1 * | 10/2003 | Maskell | 222/103 |
| 2006/0138168 | A1 * | 6/2006 | Last et al. | 222/105 |
| 2012/0181303 | A1 | 7/2012 | Swanick | |

FOREIGN PATENT DOCUMENTS

| | | | |
|---|---|---|---|
| JP | 2000335594 | A | 12/2000 |
| JP | 3935540 | B2 | 6/2007 |
| WO | 00/23327 | A1 | 4/2000 |
| WO | WO 0154991 | A1 * | 8/2001 |
| WO | 03/024822 | A1 | 3/2003 |
| WO | 2010/062247 | A1 | 6/2010 |

OTHER PUBLICATIONS

Machine translation of JP3935540(B2).

* cited by examiner

FLEXIBLE POUCH AND DOCK SYSTEM

PRIORITY

This application claims priority to U.S. Design patent application Ser. No. 29/446,105 filed on 20 Feb. 2013, and U.S. Design patent application Ser. No. 29/446,120, filed on 20 Feb. 2013, the entire content of each application incorporated by reference herein.

BACKGROUND

Liquid personal care products, such as shampoo and liquid body washes (i.e. shower gels), have historically been packaged in upright bottles having flip-top closures. More recently, liquid body washes are being contained in inverted bottles (i.e., "tottle packages"). A tottle package rests on its dispensing cap, thereby allowing gravity to pull the liquid composition towards the opening to facilitate easier dispensing when the package is opened for dispensing.

Conventional tottle packages with flip top closures (as well as packages with twist-up closures and screw-top closures) typically require the consumer to use two hands to open and close such closures. This is inconvenient, especially when the consumer product being dispensed is a liquid body wash or hair shampoo. When a consumer uses a liquid body wash, for example, she typically dispenses the body wash into her hand. The consumer cannot utilize her hand containing the product to close product package.

A need therefore exists for a liquid personal care product pouch that can be readily closed with one hand. A need further exists for a pouch that dispenses a liquid personal care product from the bottom of the pouch and can be closed with one hand.

SUMMARY

The present disclosure provides a pouch for dispensing a liquid. In an embodiment, the pouch includes a front flexible film and a rear flexible film. The front flexible film and the rear flexible film are sealed around a common peripheral edge to form a flexible body. The flexible body has a closed top and an open bottom. A flexible base is attached to the open bottom of the body. The base and body define a chamber for holding a liquid. A hole is present at a lower portion of the front flexible film. A closure is attached to the hole. The closure includes a collar, a housing, and a spout for dispensing liquid from the pouch. The collar has a duct in fluid communication with the hole. The collar is attached to an outer surface of the front film. The housing is attached the collar. The housing has a port in fluid communication with the duct. The spout is pivotally attached to the housing. The spout has a channel through which the liquid is dispensed.

The present disclosure provides a dock. In an embodiment, a dock for receiving a pouch is provided. The dock includes (i) a floor having a peripheral edge, (ii) a waist surrounding the peripheral edge and extending upward from the floor. The waist and the floor define a seat for receiving the base. The dock includes (iii) a front panel and a rear panel extending upward from opposing sides of the waist. The front panel and the rear panel are separated by a gap. The dock also includes (iv) an orifice on a front surface of the waist. The orifice is adapted to receive a closure of the pouch.

The present disclosure provides a system. In an embodiment, a system is provided and includes (A) a pouch for placement into a dock (B). The pouch includes (i) a flexible body and a base forming a closed chamber for holding a liquid. The pouch includes (ii) a closure for dispensing the liquid. The closure is attached to a lower portion of the body. The dock (B) includes (i) a floor having a peripheral edge and (ii) a waist surrounding the peripheral edge. The waist extends upward from the floor. The waist and the floor define a seat for receiving the base. The dock includes (iii) a front panel and a rear panel extending upward from opposing sides of the waist. The front panel and the rear panel are separated by a gap. The dock includes (iv) an orifice on a front surface of the waist. The orifice receives the closure.

DETAILED DESCRIPTION

Figure 1:
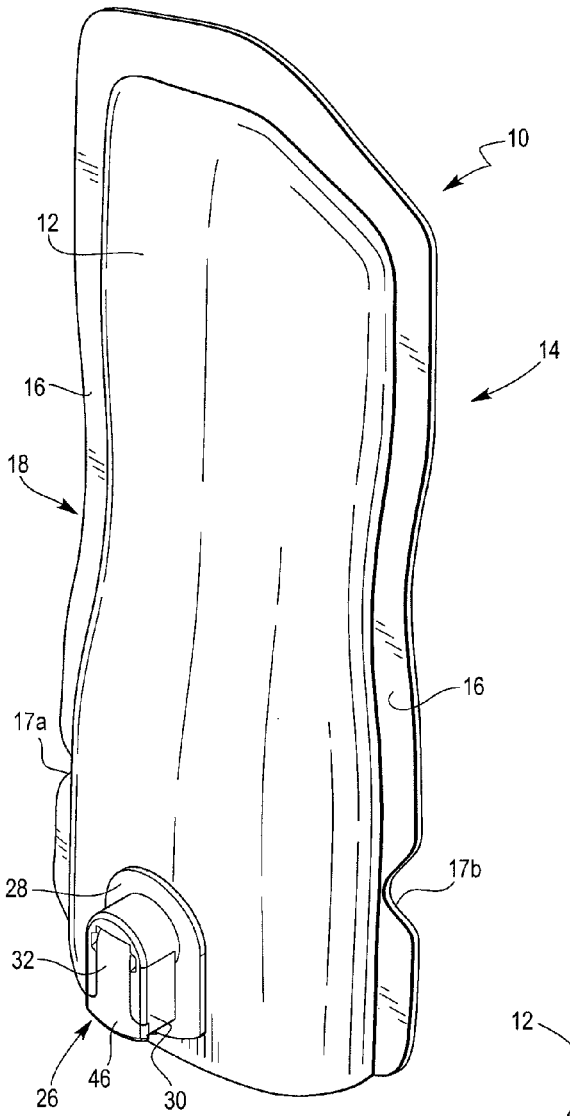
FIG. 1 is a perspective view of a pouch for dispensing a liquid in accordance with an embodiment of the present disclosure.

The present disclosure provides a pouch for dispensing a liquid. In an embodiment, the pouch includes a front flexible film and a rear flexible film. The front flexible film and the rear flexible film are sealed around a common peripheral edge to form a flexible body. The flexible body has a closed top and an open bottom. A flexible base is attached to the open bottom of the body. The base and body define a chamber for holding a liquid. A hole is present at a lower portion the front film of the body. A closure is attached to the hole. The closure includes a collar, a housing, and a spout for dispensing liquid from the pouch.

1. Body

The present pouch includes a front film and a rear film (hereafter, collectively the "film"). Each of the front film and the rear film is a flexible film. The front film and the rear film are sealed around a common peripheral edge to form the flexible body. The flexible body has a closed top and an open bottom.

Each of the front film and the rear film is resilient, flexible and deformable. Correspondingly, the body is resilient, flexible, and deformable. The body is flexible enough to deform, but also resilient enough to return to its original shape.

The front film and the rear film each is constructed from a polymeric material. The film may be a monolayer structure or a multilayer structure. The front film and the rear film can be made from a single film (a film folded over upon itself and peripherally sealed). Alternatively, the front film is a first flexible film peripherally sealed to a second flexible film that is the rear film. The front film is sealed to the rear film around a common peripheral edge to form the body. The common peripheral edge can be sealed by way of a heat seal, a weld (ultrasonic or radio frequency (Rf)), an adhesive bond, and combinations thereof.

The front film and the rear film can be the same or different. In an embodiment, the front film is the same as the rear film.

Each film is made from a polymeric material. Nonlimiting examples of suitable polymeric materials include olefin-based polymer, propylene-based polymer (including plastomer and elastomer, random copolymer polypropylene, homopolymer polypropylene, and propylene impact copolymer) and ethylene-based polymer (including plastomer and elastomer, high density polyethylene ("HDPE"), low density polyethylene ("LDPE"), linear low density polyethylene ("LLDPE"), medium density polyethylene ("MDPE")), olefin block copolymer, polyethylene terephthalate ("PET"), oriented polyethylene terephthalate ("OPET"), nylon, biaxially oriented polypropylene (BOPP), ethylene vinyl alcohol (EVOH), functionalized ethylene-based polymers such as ethylene-vinyl acetate ("EVA"), maleic anhydride-grafted polyethylene, and ethylene acrylate copolymers, fluorinated ethylene propylene, blends thereof, and multilayer combinations thereof.

In an embodiment, the pouch is made from two opposing webs, each web composed of the flexible multilayer film. The composition of each web may be the same or different. In a further embodiment, the pouch is made from two webs, each web composed of a flexible multilayer film having the same structure and the same composition.

In an embodiment, the flexible multilayer film has an innermost layer that is a seal layer, an outer print layer, and optional intermediate layers sandwiched between the seal layer and the print layer.

In an embodiment, printing is applied to the webs during construction of the pouch, thereby forming a flexible multilayer film having a print layer. The printing includes advertisement, branding, instructions for use, instructions for recycle, and any combination thereof. The print web is subsequently laminated to a sealant web by applying an adhesive layer to the print web and/or the sealant web.

The print web may be direct-printed and covered with a layer of protective varnish. Alternatively, the print web may be reverse-printed and laminated to a sealant web by applying an adhesive layer to the print web and/or the sealant web. Any web may contain a filler to provide either additional stiffness, opacity, or both stiffness and opacity.

In an embodiment, the print layer is a polymeric material selected from biaxially or uniaxially oriented polypropylene (BOPP, OPP), PET, bi-axially oriented PET (BOPET), and combinations thereof.

In an embodiment, the seal layer is a polymeric material selected from LLDPE, single-site LLDPE (substantially linear olefin polymers, including polymers sold under the tradename AFFINITY (The Dow Chemical Company) for example), or propylene-based plastomers or elastomers and their blends, ethylene-vinyl acetate, blends with polyisobutylene (PIB), and blends with ionomers (AMPLIFY), and combinations thereof.

In an embodiment, the seal layer is an ethylene-based polymer such as LLDPE and the print layer is a PET. The PET allows for printing to be easily placed directly on the flexible multilayer film because it does not stretch during the printing process. The LLDPE seal layer allows for the formation of heat seals during formation of the pouch.

In an embodiment, each of the front film and the rear film is a flexible multilayer film having a thickness from 25 microns, or 50 microns, or 75 microns to 100 microns, or 125 microns, or 150 microns, or 200 microns, or 220 microns.

The hand-feel perception of the body is related to the surface roughness of the flexible multilayer film at the microscopic level. Surface roughness, also known as surface profile, $R_a$, is a measurement of surface finish. It is topography at a scale that might be considered "texture" on the surface. Surface roughness is a quantitative calculation of the relative roughness of a linear profile or area, expressed as a single numeric parameter ($R_a$). The surface roughness of the container body can be measured with a confocal laser microscope, for example. A nonlimiting example of a suitable instrument for measuring surface roughness is a ZeMapper Optical Profiler, manufactured by Zemetrics, Inc., Tuscon, Ariz., USA.

In an embodiment, the body has a surface roughness, $R_a$, from 0.2 to 0.8.

In an embodiment, the front film and the rear film each is a flexible multilayer film having an innermost seal layer, an outermost print layer and one or more optional intermediate layers sandwiched between the innermost layer and the outermost layer. The intermediate layers may include barrier layers, adhesive layers, structural layers, and combinations thereof. The multilayer film may be produced by way coextrusion, lamination, and combinations thereof.

In an embodiment, the body is made from a front film and a rear film each film being a flexible multilayer film having an LLDPE sealant layer, an LDPE, LLDPE or HDPE intermediate layer, and a PET print layer. The LLDPE for the sealant layer has a secant flexural modulus from 20,000 psi to 80,000 psi as measured in accordance with ASTM D 882. Each film has a thickness from 90 microns to 110 microns. Each flexible multilayer film has a secant flexural modulus from 70,000 psi, or 73,000 psi to 100,000 psi or 101,000 psi as measured in accordance with ASTM D 882. The sealed flexible multilayer films produce a body (at the seal area) that has a thickness from 180 microns to 220 microns, or 200 microns.

2. Base

The present pouch includes a flexible base attached to the open bottom of the body. The base is attached to the open bottom of the body to form a gusset. The gusset may be formed by way of heat seal, weld (ultrasonic or Rf), adhesive bond, and combinations thereof. The body and the base define a closed and hermetically sealed chamber for holding the liquid.

The hermetically sealed chamber holds the liquid. Nonlimiting examples of suitable liquids include liquid personal care products such as shampoo, conditioner, liquid soap, lotion, gel, cream, balm, and sunscreen. Other suitable liquids include household care/cleaning products and automotive care products. Other liquids include liquid food such as condiments (ketchup, mustard, mayonnaise) and baby food.

The base is made of a flexible polymeric material. In an embodiment, the base has the same structure and composition as the front film and the rear film. The gusset provides the base with (1) the structural integrity to support the body and the liquid in the chamber without leakage, and (2) the stability to stand upright (i.e., base on a support surface, such as a horizontal surface, or a substantially horizontal surface), without tipping over. In this sense, the pouch is a "stand-up" pouch.

The gusset structure and the resiliency of the base enable the base to be flexed, shaped, or otherwise bent, to vary the depth of the pouch. From a maximum pouch depth, the base can be flexed to reduce the depth from 1%, or 2%, or 3%, or 5%, or 7% to 8%, or 10%, or 12%, or 15%.

In an embodiment, the body and base together have a contoured shape.

The base includes a gusset rim that defines a footprint for the pouch. The footprint can have a variety of shapes. Nonlimiting examples of suitable shapes for the footprint include circle, square, rectangle, triangle, oval, ellipsoid, eye-shape, and teardrop. In a further embodiment, the shape of the footprint is ellipsoid.

A hole is located at a lower portion of the front film. The hole is located from 1 millimeters (mm), or 2 mm, or 3, mm, or 4 mm, or 5 mm to 6 mm, or 7 mm, or 8 mm, or 9 mm, or 10 mm, or 15 mm, or 20 mm above the base to ensure complete dispensing of the liquid from the chamber.

3. Closure

The present pouch includes a closure. The closure is attached to the hole. The closure includes (i) the collar, (ii) the housing, and (iii) the spout. One or more polymeric materials are formed into rigid, or semi-rigid, parts to form the closure components. Nonlimiting examples of suitable polymeric materials for the closure components include propylene-based polymer, LDPE, HDPE, blends thereof, and combinations thereof.

The collar has a duct. The collar is attached to an outer surface of the front film so as to align the collar duct with the hole, thereby providing fluid communication between the hole and the duct. Nonlimiting examples of suitable attachment between the collar and the exterior surface of the front film include heat seal, weld (ultrasonic, Rf), adhesive bond, and combinations thereof.

The housing is attached to the collar. In an embodiment, the housing and the collar are two distinct components. Nonlimiting examples of suitable attachment between the collar and housing include friction fit, heat seal, weld (ultrasonic, Rf), adhesive bond, and combinations thereof. Alternatively, the collar and the housing are integral, the housing and the collar each subcomponents of a single component.

The housing includes a port. The port of the housing is in fluid communication with the duct of the collar.

The housing includes a recess and an upper rim. A first well is located on one side of the recess and a second well is located on a second side of the recess opposite the first well. The first well and the second well are proximate to the port.

The spout includes a channel through which the liquid is dispensed. The channel extends through the length of the spout. The spout is pivotally attached to the housing. A pair of opposing pins is located at a proximate end of the spout. A first pin is located on a first side of the spout and a second pin is located on a second side of the spout, the second side opposite to the first side. The pins are perpendicular to the channel. The first pin frictionally engages the first well and the second pin frictionally engages the second well. The pins engaged and aligned with the wells define an axis of rotation for the spout.

The recess receives the spout when the closure is in the closed position. When the spout is in the recess, the upper rim of the housing surrounds the spout (except the distal flange). In the closed position, the spout rests in the recess such that a proximate end of the channel does not fluidly communicate with the port. In the closed position, the underside of the spout blocks liquid in the chamber from flowing through the port and into the channel. In the closed position, the rim of the housing and the outer surface of the spout are coplanar, or substantially coplanar.

A distal end of the spout is the dispensing end. When the distal end of the spout is moved radially outward from the housing, the proximate end of the spout pivots about the axis of rotation. The pivoting motion moves the spout to an open position where the proximate end of the channel is placed into fluid communication with the port. In the open position, liquid from the chamber flows through the hole, through the duct, through the port, through the channel, and out of the spout.

In an embodiment, the distal end of the spout includes a flange. A user placing her fingertip under the flange can readily pivot the spout from the closed position to the open position, and vice versa.

The closure permits bottom dispensing of the liquid from the pouch.

In an embodiment, the pouch can be operated or otherwise used with a single hand. A user holds the base of the pouch in her palm, freeing her thumb. The user places her thumb under the flange of the spout and flicks her thumb away from the pouch to open the spout while supporting the base with her palm and the body with her fingers. The user can close the open spout by placing the pad of her thumb on the spout and moving the thumb toward the pouch, while supporting the base with her palm and supporting the body with her fingers.

In an embodiment, the closure of the present pouch does not include a silicone valve (no silicone slit valve, for example). Consequently, the present pouch is silicone-free.

In an embodiment, the present pouch is made from 90 wt % to 100 wt % ethylene-based polymer—the body being composed of flexible multiple layer film with layer materials selected from ethylene-based polymer such as LLDPE, LDPE, HDPE, and combinations thereof, and the base, nozzle and closure are composed of rigid HDPE. Weight percent is based on total weight of the pouch without liquid. The pouch made from 90 wt % to 100 wt % ethylene-based polymer is advantageous as it is readily recyclable.

In an embodiment, the height of the pouch is from two times (2×) to three times (3×) greater than the width of the pouch. In a further embodiment, the pouch height is 2.9 times (2.90×) greater than the pouch width.

In an embodiment, the pouch height is from three times (3×) to six times (6×) greater than the pouch depth. In a further embodiment, the pouch height is five times (5×) greater than the pouch depth.

In an embodiment, the pouch has a height from 200 mm, or 210 mm, or 230 mm to 250 mm, or 260 mm.

In an embodiment, the pouch has a width from 60 mm, or 70 mm to 80 mm, or 90 mm.

In an embodiment, the pouch has a depth from 40 mm, or 45 mm to 50 mm, or 55 mm.

In an embodiment, the pouch has a height of 230 mm, a width of 80 mm, a maximum depth of 50 mm, and holds 355 milliliters (12 ounces) of liquid.

4. System

The present disclosure provides a system for dispensing a liquid. The system includes a pouch for placement into a dock. The pouch is loadable into the dock. The pouch is also removable from the dock.

The pouch includes a flexible body and a base forming a closed chamber for holding a liquid. The pouch also includes a closure for dispensing the liquid. The closure is attached to a lower portion of the body.

In an embodiment, the pouch is the pouch as disclosed above.

The dock includes a floor, a waist, a front panel, and a rear panel. The dock is made from a resilient polymeric material. Nonlimiting examples of suitable polymeric materials include olefin-based polymer, propylene-based polymer (propylene homopolymer, random copolymers of propylene and ethylene (RCP), and impact modified polypropylene (ILP)), has the appearance of flowing ethylene-based polymer, high density polyethylene ("HDPE"), low density polyethylene ("LDPE"), linear low density polyethylene ("LLDPE"), and medium density polyethylene ("MDPE"), olefin block copolymer, and combinations thereof.

In an embodiment, the dock is a single-piece molded article composed of the polymeric material. The molded article can be an injection molded article or a blow molded article.

The floor has a peripheral edge. The waist surrounds the peripheral edge of the floor. The waist extends upward from the peripheral edge. The waist and the floor define a seat for receiving the base of the pouch.

The floor has a footprint. The floor footprint can have a variety of shapes. Nonlimiting examples of suitable shapes include circle, rectangle, square, triangle, oval, ellipsoid, eye-shape, and teardrop.

The front panel and the rear panel extend upward from opposing sides of the waist. A gap is present between the front panel and the rear panel. The upper end of the front panel stands freely with respect to the upper end of the rear panel. The opposite ends of the panels are connected to the waist, or are otherwise integral to the waist. The gap enables the panels to move relative to each other. In other words, the gap enables the front panel and the rear panel to move toward and away from each other. The polymeric material from which the panels are made is flexible enough for panels to be moved outward (or away from each other) for installation of the pouch into the dock. The polymeric material is also resilient enough for the panels to move back to their original positions once the pouch is placed in the dock (or when the pouch is removed from the dock), or after the panels are squeezed inward to push liquid through the open spout.

The front panel and the rear panel have a contour shape. In an embodiment, the rear panel has a shape that is a mirror image of the front panel shape.

An orifice is located on a front surface of the waist. The orifice receives the closure of the pouch when the pouch is placed in the dock. Nonlimiting examples of suitable shapes for the orifice include square, rectangle, triangle, circle, oval, and ellipse. The closure extends radially outward from the dock when the pouch is installed in the dock.

In an embodiment, the shape of the orifice matches the shape of the closure. In a further embodiment, the closure has an oval shape and the orifice has an oval shape.

The waist has a width that is wider than the width of each individual front/rear panel. The dock includes two tapered portions, located at opposing sides of the waist. Each tapered portion is located at a lower end of the gap and between the front panel and the rear panel. At the tapered portion, an upper edge of the waist gradually tapers inward and merges into an outer edge of each panel. In an embodiment, the upper edge is a U-shaped edge. The U-shaped edge provides the dock with a contoured, smooth and uniform appearance. The waist has the appearance of flowing into the front panel and the rear panel at the tapered portions.

In an embodiment, the body of the pouch includes flutes located at opposing sides of the common peripheral edge. When the pouch is placed in the dock, each flute contacts a respective U-shaped edge of the waist. In this way, the U-shaped edge supports the pouch at the contact point with the flute.

Applying pressure on one panel (or on both panels) dispenses liquid from the pouch when the closure is in the open position. Pressure can be applied as a squeezing motion using two opposing fingers, for example.

The dock advantageously provides additional support and additional stability to the flexible pouch. The present system reduces tipping and spilling of the pouch.

When empty, the flexible pouch is removed from the dock. Another flexible pouch can then be installed into the dock.

In an embodiment, the system (pouch and the dock no liquid) is made from 90 wt % to 100 wt % ethylene-based polymer—such as LLDPE, LDPE, MDPE, and HDPE. The system is made from 90 wt % to 100 wt ethylene-based polymer and is advantageous as it is readily recyclable.

DEFINITIONS

The numerical figures and ranges here are approximate, and thus may include values outside of the range unless otherwise indicated. Numerical ranges (e.g., as "X to Y", or "X or more" or "Y or less") include all values from and including the lower and the upper values, in increments of one unit, provided that there is a separation of at least two units between any lower value and any higher value. As an example, if a compositional, physical or other property, such as, for example, temperature, is from 100 to 1,000, then all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. For ranges containing explicit values (e.g., 1 or 2, or 3 to 5, or 6, or 7) any subrange between any two explicit values is included (e.g., 1 to 2; 2 to 6; 5 to 7; 3 to 7; 5 to 6; etc.).

An "ethylene-based polymer," as used herein is a polymer that contains more than 50 mole percent polymerized ethylene monomer (based on the total amount of polymerizable monomers) and, optionally, may contain at least one comonomer.

An "olefin-based polymer," as used herein is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

"Polymer" means a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term interpolymer, usually employed to refer to polymers prepared from at least two types of monomers. It also embraces all forms of interpolymers, e.g., random, block, etc. The terms "ethylene/α-olefin polymer" and "propylene/α-olefin polymer" are indicative of interpolymers as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is obviously understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 mole percent polymerized propylene monomer (based on the total amount of polymerizable monomers) and, optionally, may contain at least one comonomer.

The term "tottle," as used herein, is a package comprising a bottle and a closure attached to the bottle, wherein the package is designed to rest on its closure. Many shampoos, hair conditioners, shaving lotions, body washes, in-shower body moisturizers, and other products used in the shower or bath are contained in tottles. Many food condiments are also contained in tottles, such as ketchup, mayonnaise, mustard, and the like.

EXAMPLES

The following is one embodiment of the present disclosure, as depicted in the drawings. While this describes one embodiment of the present disclosure, it will be apparent to those skilled in the art that various changes and modifications can be made without departing from the spirit and scope of the disclosure.

FIG. 1 shows a perspective view of a pouch 10 for dispensing a liquid. The pouch 10 includes a front flexible film 12 and a rear flexible film 14 that are heat sealed around a common peripheral edge 16 to form a body 18. The common peripheral edge 16 that is heat sealed forms a closed top and an open bottom for the body 18. In an embodiment, each of the front flexible film 12 and the rear flexible film 14 is a multilayer laminate composed of a PET print layer/tie/LDPE core layer/LLDPE seal layer. In an embodiment, the common peripheral edge 16 that is heat sealed has a thickness of 200 microns.

Figure 2:
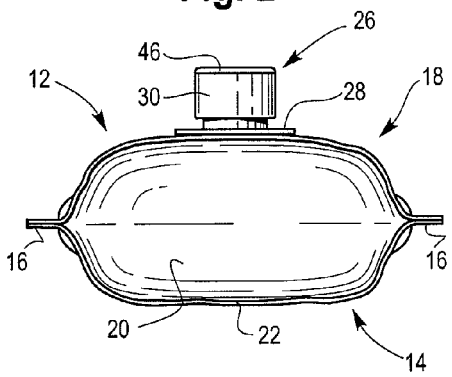
FIG. 2 is a bottom plan view of the pouch in FIG. 1.

FIG. 2 shows a base 20 attached to the open bottom of the body 18. The base 20 is heat sealed to the front film 12 and the rear film 14. The body 18 and the base 20 form a closed chamber that is hermetically sealed. The closed chamber holds the liquid in a watertight and/or an airtight manner. In an embodiment, the base 20 is composed of the same flexible multilayer film as the front film 12 and the rear film 14.

The base 20 includes a gusset rim 22 that defines a footprint for the pouch. In an embodiment, the gusset rim 22 forms an ellipsoid footprint as shown in FIG. 2.

In an embodiment, flutes 17*a*, 17*b* are present on opposing sides of the common peripheral edge 16. The flutes 17*a* and 17*b* are aligned with the top portion of the closure 26. The flutes 17*a*, 17*b* are for use with the system as further described below.

Figure 3:
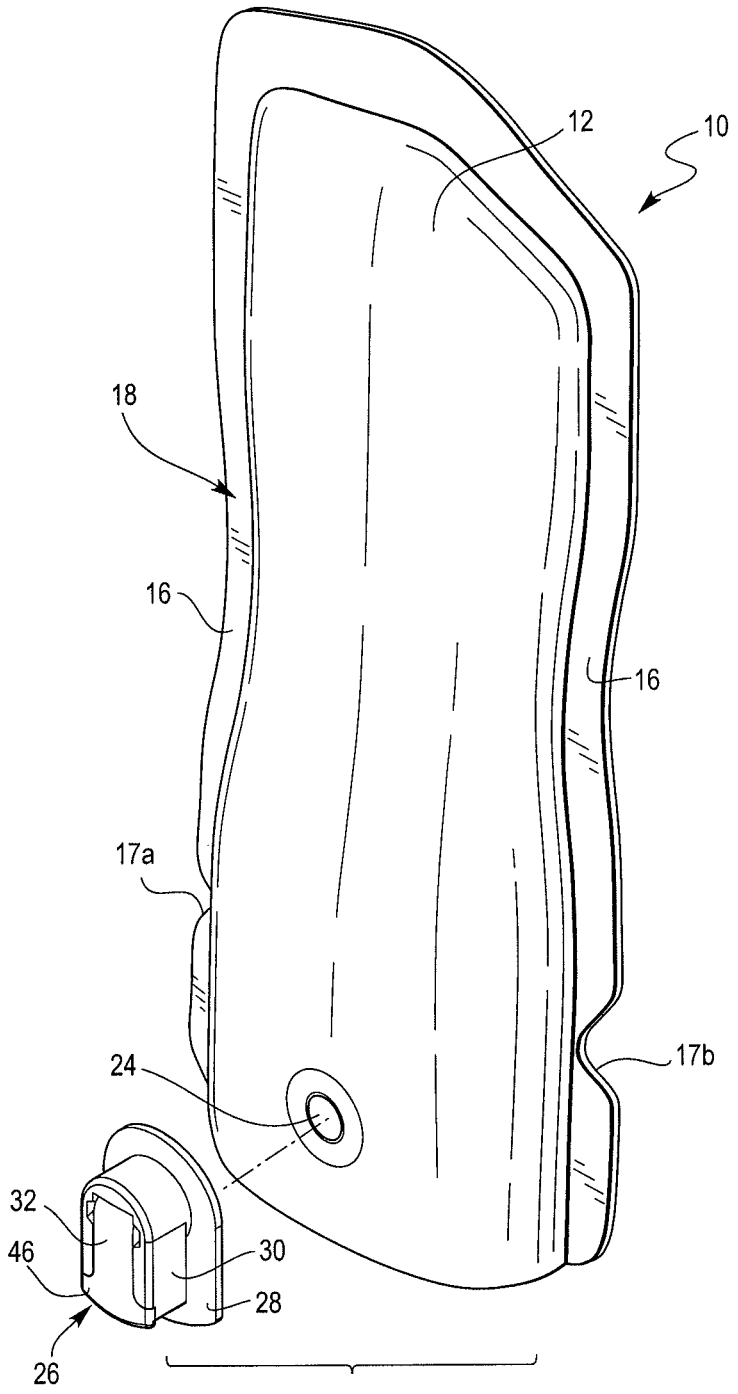
FIG. 3 is an exploded view of the pouch in FIG. 1.

As shown in FIG. 3, a hole 24 is located on the front film 12. A closure 26 is attached to the hole 24. The closure 26 includes a collar 28, a housing 30 attached to the collar 28, and a spout 32 pivotally attached to the housing 30.

Figure 4A:
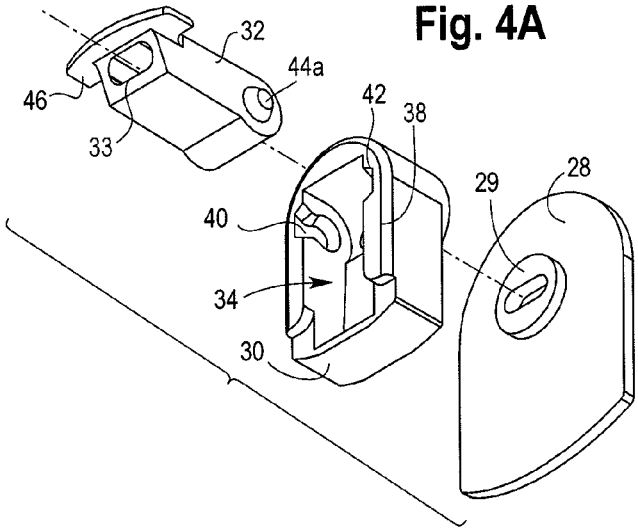
FIGS. 4A and 4B are exploded perspective views of a closure in accordance with an embodiment of the present disclosure.
Figure 4B:
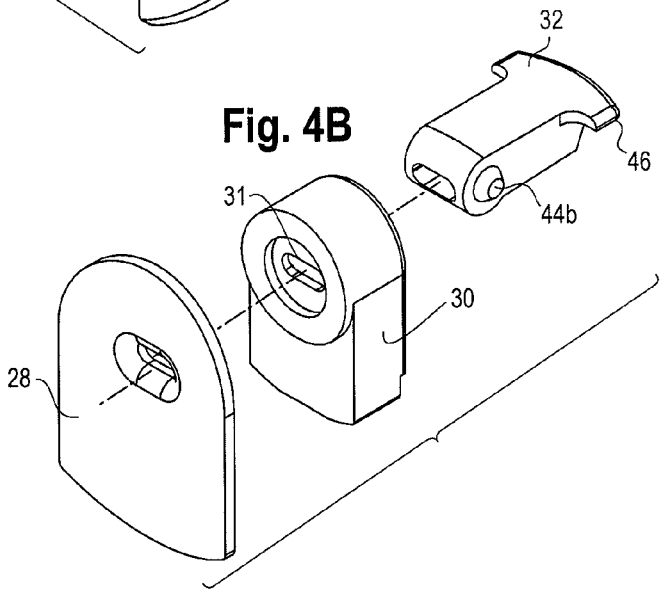
Figure 4C:
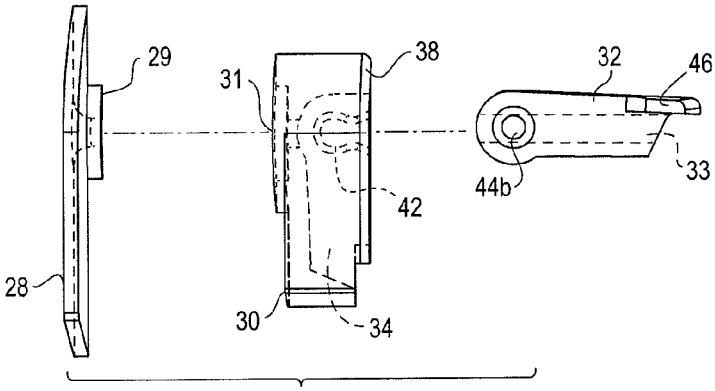
FIG. 4C is an exploded side elevational view of the closure.

In an embodiment, the collar 28 is welded to the hole 24 as shown in FIG. 3. The collar 28 includes a duct 29 that extends radially outward from the body 18 as shown in FIG. 4A. The duct 29 is in fluid communication with the hole 24. The housing 30 includes a port 31 that matingly receives the duct 29 as shown in FIGS. 4B and 4C. The duct 29 and the port 31 attach in a male-female engagement. The engagement between the duct 29 and the port 31 can be friction fit, adhesive seal, heat seal, weld, or combinations thereof. The port 31 is in fluid communication with the duct 29.

In FIGS. 4A-4C, the spout 32 includes a channel 33 through which the liquid (in the chamber) is dispensed. Interior structures are shown with phantom lines in FIG. 4C. The housing 30 includes a recess 34 and a rim 38. A first well 40 aligns with a second well 42 on opposing sides of the recess 34. A pair of pins 44*a*, 44*b* is located on a proximate end of the spout 32. The pins 44 are perpendicular to the channel 33. The pin 44*a* frictionally engages with the first well 40 and the pin 44*b* frictionally engages with the second well 42 to define an axis of rotation for the spout 32.

Figure 5:
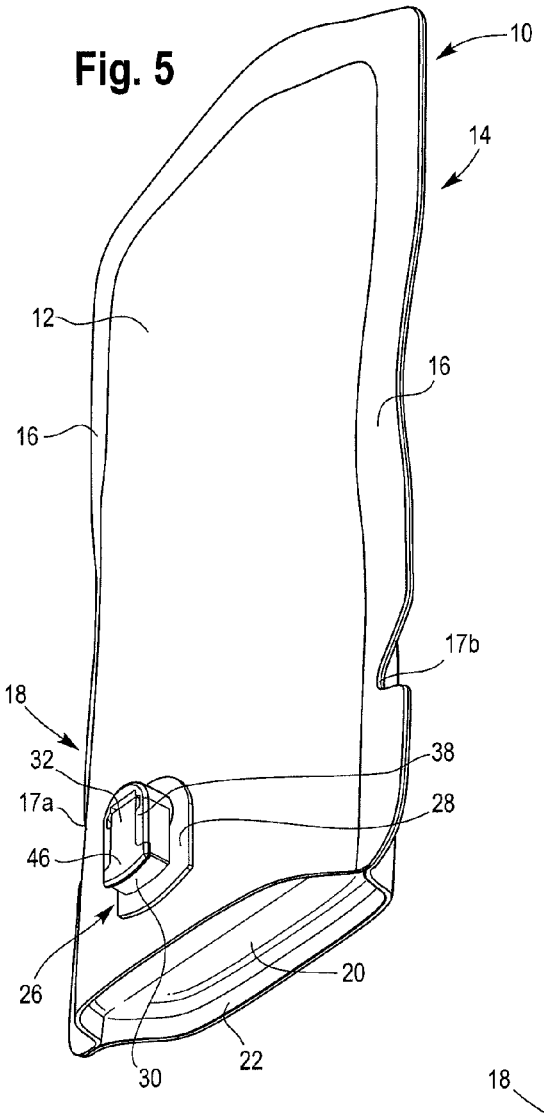
FIG. 5 is a bottom perspective view of the pouch with the closure in a closed position in accordance with an embodiment of the present disclosure.

When the closure 26 is in the closed position as shown in FIG. 5, the recess 34 receives the spout 32. In the closed position, the underside of the spout 32 blocks fluid flow through the port 31, preventing liquid in the chamber from being dispensed. In the closed position, the rim 38 is coplanar, or substantially coplanar, with the outer surface of the spout 32.

Figure 6:
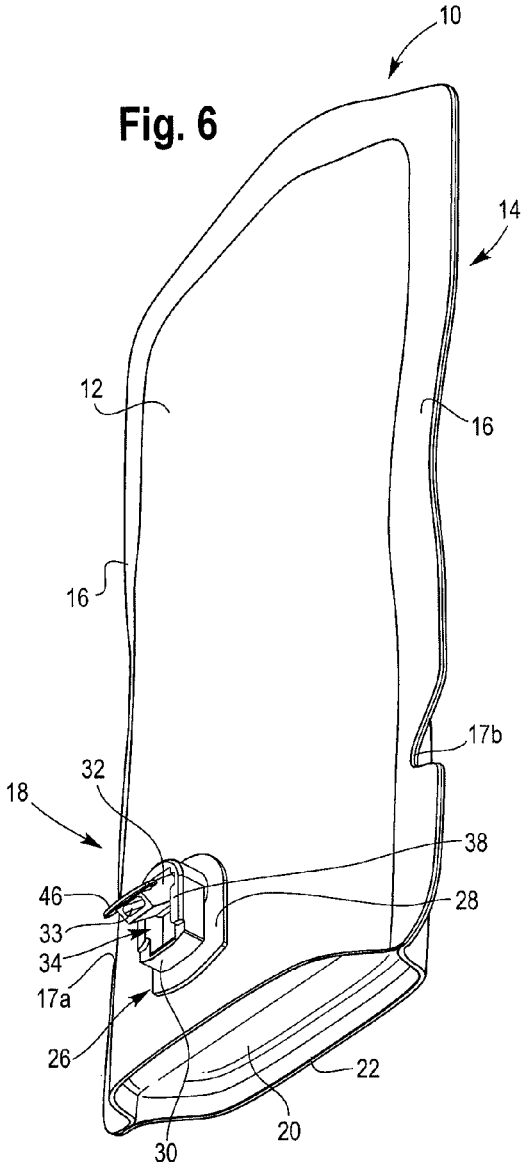
FIG. 6 is a bottom perspective view of the pouch with the closure in an open position in accordance with an embodiment of the present disclosure.

FIG. 6 shows the closure 26 in the open position. A distal end of the spout 32 includes a flange 46. To move the closure 26 to the open position a user places a fingertip (or a fingernail) under the flange 46, and pulls the flange 46 radially outward and away from the housing 30. The proximate end of the spout 32 pivots about the axis of rotation and moves the proximate end of the channel 33 into fluid communication with the port 31. When the closure 26 is in the open position, the proximate end of the channel 33 is in fluid communication with the port 31. The user then squeezes the body 18 to push liquid from the chamber through the hole 24, through the duct 29, through the port 31, through the channel 33 and out of the spout 32.

To move the closure from the open position to the closed position, the user pushes the distal end of the spout 32 radially inward and toward the housing 30, placing the spout 32 into the recess 34.

FIGS. 7-13 show a system 50 for dispensing a liquid. The system 50 includes the pouch 10 as disclosed above. The system 50 also includes a dock 52. The dock 52 has a floor 54 with a peripheral edge 56. The dock 52 also has a waist 58 surrounding the peripheral edge 56. The waist 58 extends upward from the floor 54. The waist 58 and the floor 54 define a seat 60 for receiving the base of the pouch 10.

A front panel 62 and a rear panel 64 extend upward from opposing sides of the waist 58. The front panel 62 and the rear panel 64 have a contoured shape. In an embodiment, the shape of the rear panel 64 is a mirror image of the shape of the front panel 62. A gap 66 (FIGS. 8C, 8D) separates the front panel 62 from the rear panel 64.

In an embodiment, the gap 66 has a length from 15 millimeter (mm), or 20 mm, or 25 mm to 30 mm, or 35, or 40 mm.

Figure 7:
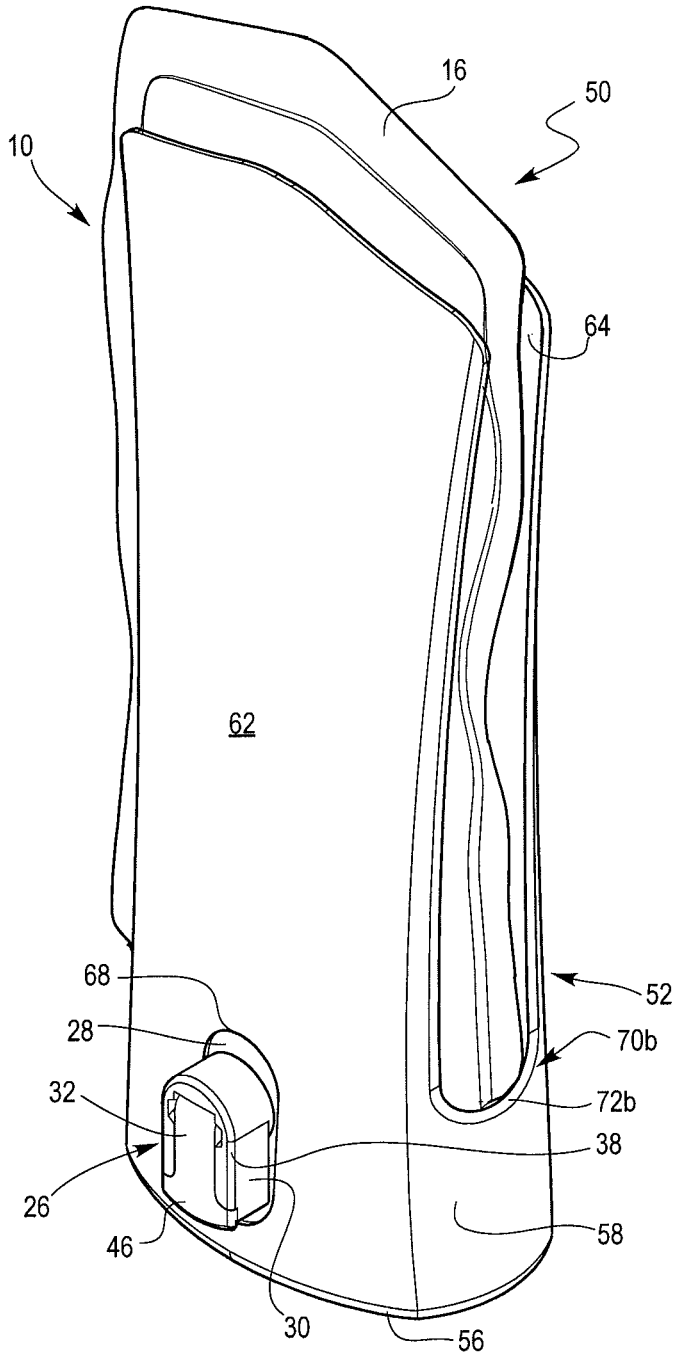
FIG. 7 is a perspective view of a system for dispensing a liquid in accordance with an embodiment of the present disclosure.

An orifice 68 is located on a front surface of the waist 58. The orifice 68 is configured to receive the closure 26 of the pouch 10. In an embodiment, the orifice 68 has an elliptical shape that matches the elliptical shape of the closure 26, as shown in FIGS. 7-9.

In an embodiment, the dock 52 is a single-piece molded article composed of HDPE. The HDPE is flexible enough to provide resilience (bending and return to original position) of the front panel 62 and the rear panel 64. In this way, the front panel 62 and the rear panel 64 are moveable with respect to each other. The HDPE is rigid enough to provide the dock 52 the strength and stability to support the pouch 10 that is inserted therein.

On opposing ends, the dock 52 includes tapered portions 70*a* and 70*b* at the lower end of the gap 66. The tapered portions 70*a* and 70*b* are located between the front panel 62 and the rear panel 64. The waist 58 is wider than the width of the lower portion for each front panel and rear panel 62, 64.

Figure 8A:
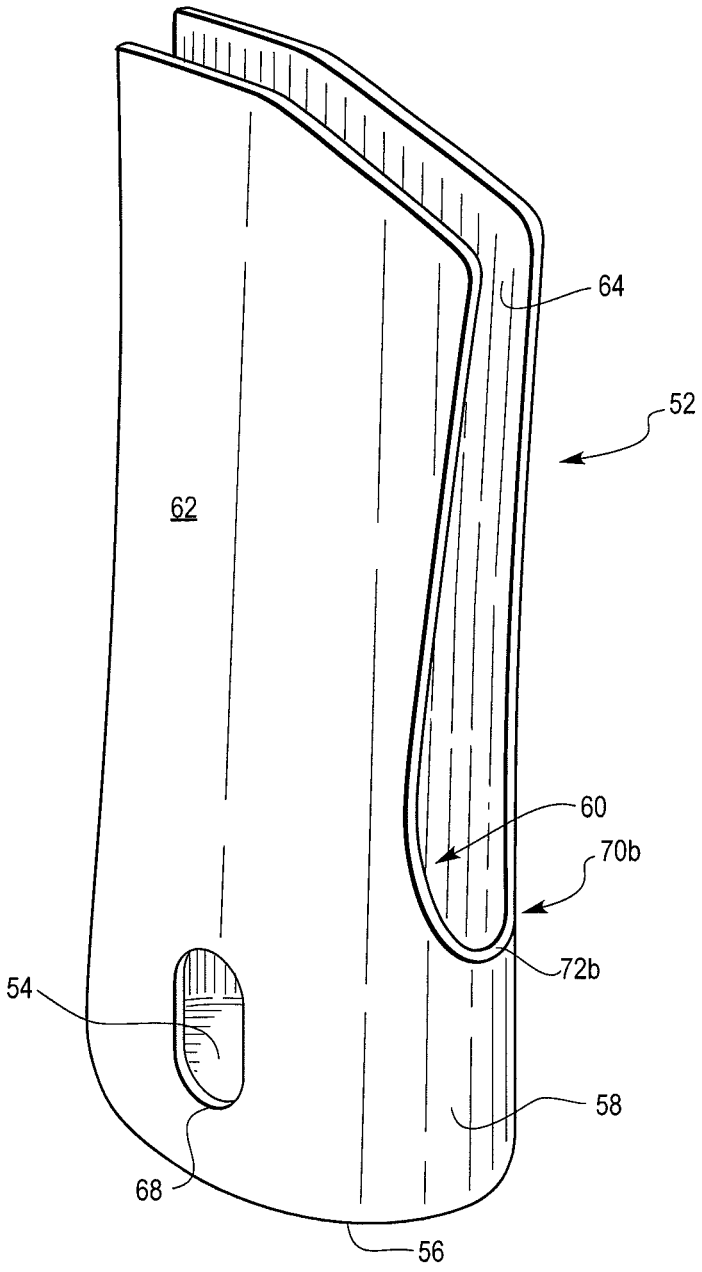
FIG. 8A is a perspective view of a dock in accordance with an embodiment of the present disclosure.
Figure 8C:
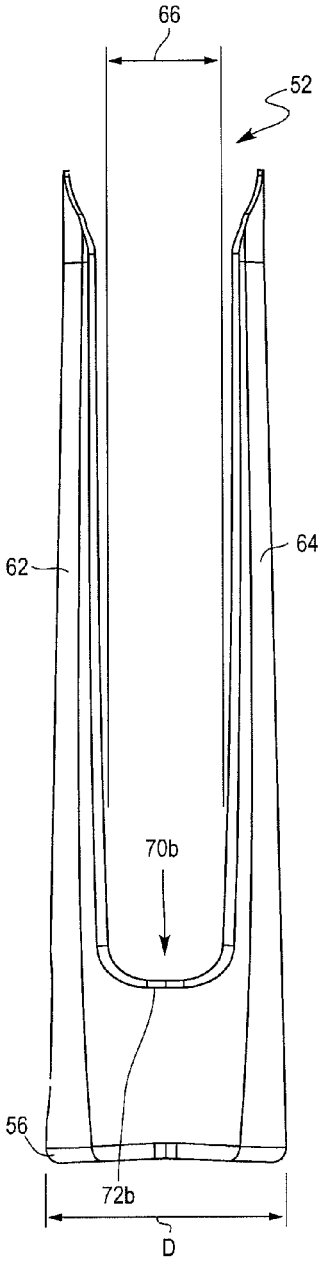
FIG. 8C is a side elevation view of the dock of FIG. 7.
Figure 8B:
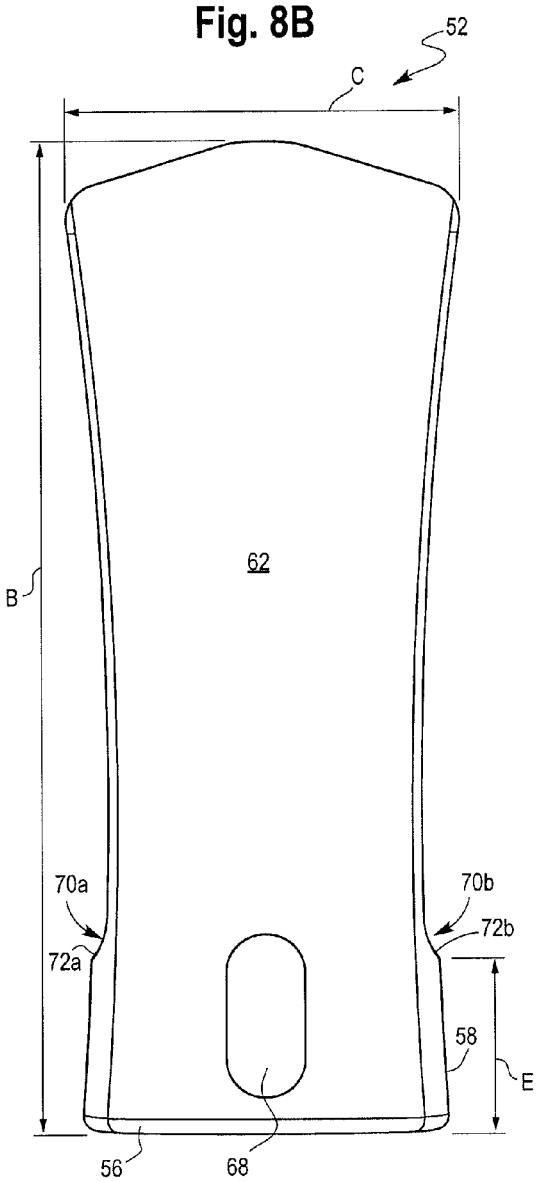
FIG. 8B is a front elevation view of the dock of FIG. 7.
Figure 8D:
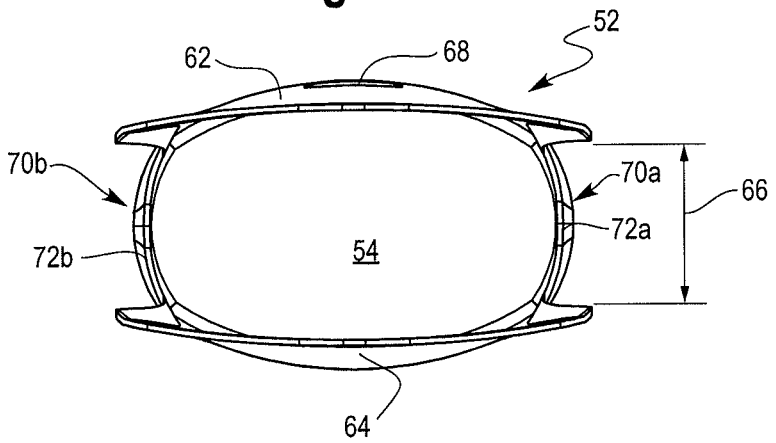
FIG. 8D is a top plan view of the dock of FIG. 7.
Figure 8E:
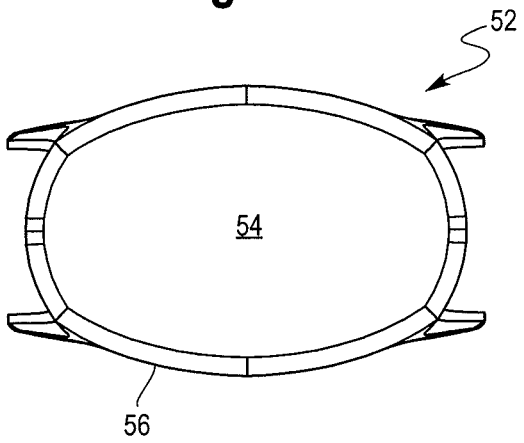
FIG. 8E is a bottom plan view of the dock of FIG. 7.
Figure 9:
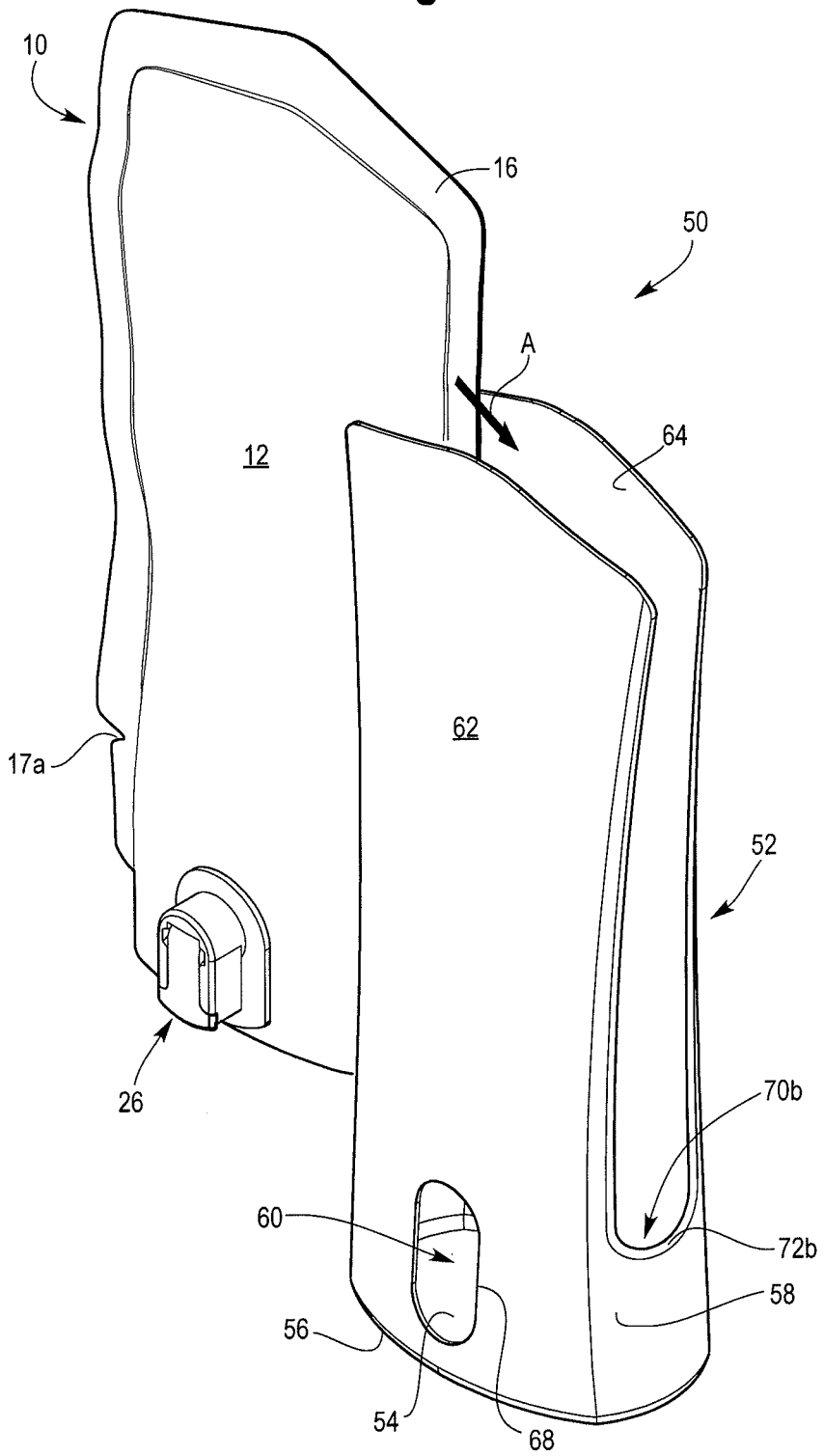
FIG. 9 is a perspective view of the system for dispensing a liquid and the pouch being loaded into the dock in accordance with an embodiment of the present disclosure.
Figure 10:
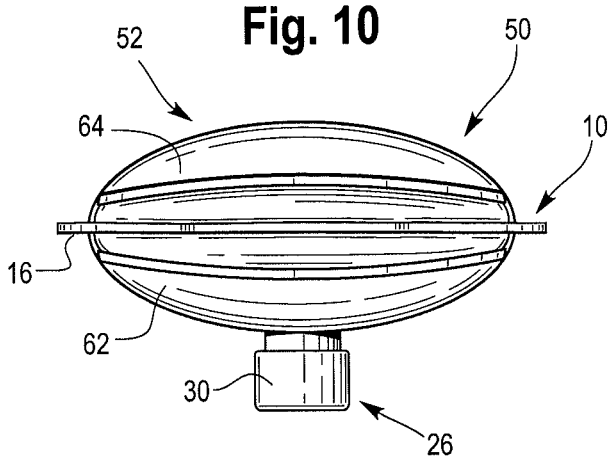
FIG. 10 is a top plan view of the system for dispensing a liquid in accordance with an embodiment of the present disclosure.
Figure 11:
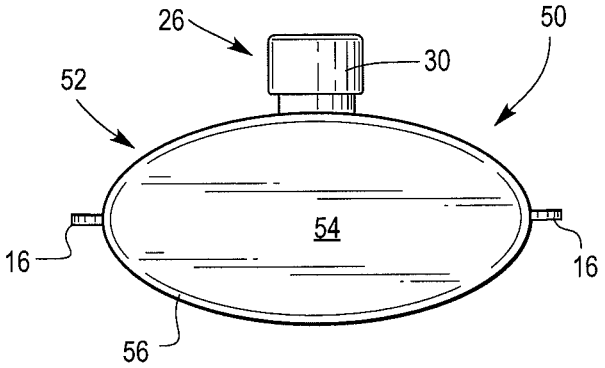
FIG. 11 is a bottom plan view of the system for dispensing a liquid in accordance with an embodiment of the present disclosure.
Figure 12:
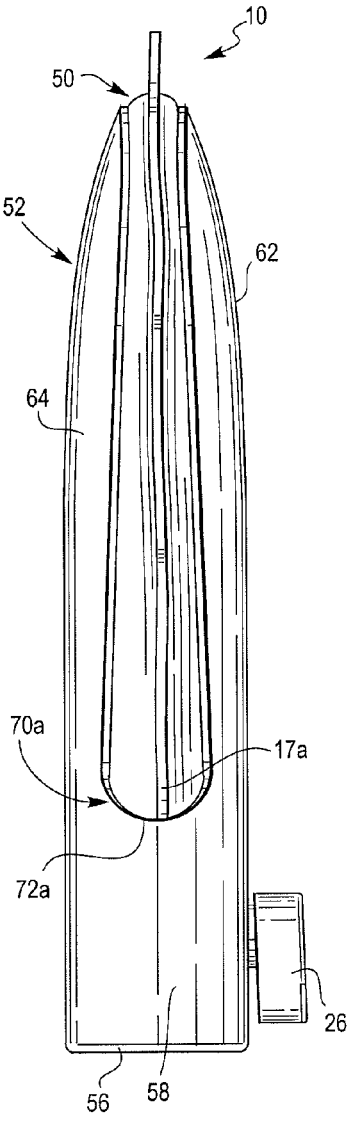
FIG. 12 is a side elevation view of the system for dispensing a liquid in accordance with an embodiment of the present disclosure.
Figure 13:
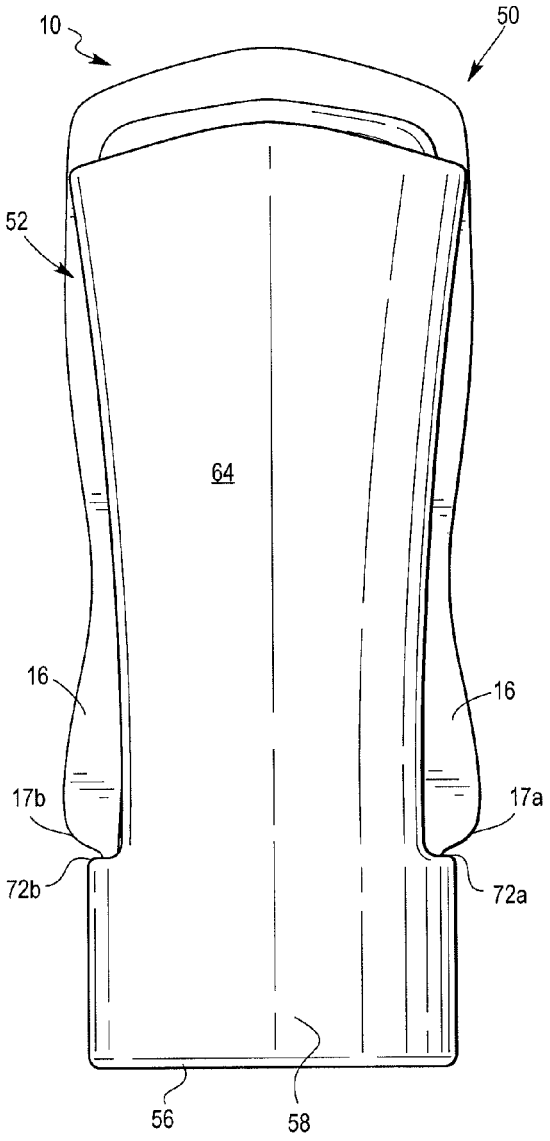
FIG. 13 is a rear elevation view of the system for dispensing a liquid in accordance with an embodiment of the present disclosure.

At the tapered portions 70*a* and 70*b*, the wider waist 58 flows inward and smoothly merges into an outer edge 72*a* and an outer edge 72*b* as shown in FIG. 8B. Each outer edge 72*a*, 72*b* extends between the front panel 62 and the rear panel 64. Each outer edge 72*a*, 72*b* extends along the top of the waist 58. In an embodiment, each outer edge 72*a*, 72*b* is a U-shaped edge.

As shown by arrow A in FIG. 9, a user loads the pouch 10 into the dock 52 through the gap 66 and places the base 20 to rest in the seat 60. The gusset rim 22 contacts the floor 54. The user also directs closure 26 to travel through the orifice 68 and extend radially outward therefrom. The front panel 62 and the rear panel 64 have the resiliency to flex, or bend, radially outward to accommodate the pouch 10 and the protruding closure 26 during the installation process. Once the base 20 is situated in the seat 60, the front panel 62 and the rear panel 64 return to their original positions to hug, or otherwise contact, the respective front film 12 and rear film 14 of the pouch 10. The closure 26 extends radially outward from the orifice 68.

The flutes 17*a*, 17*b* of the pouch 10 contact respective outer edges 72*a*, 72*b* providing additional support and stability for the pouch 10 in the dock 52.

By squeezing the front panel 62 and the rear panel 64, the user applies inward pressure on the body 18 and dispenses liquid from the closure 26 when in the open position. The system 50 permits bottom dispensing of the liquid from the pouch 10.

The system 50 advantageously provides additional stability to the flexible pouch 10. When the pouch 10 is placed in the dock 52, the system 50 advantageously reduces the risk of tipping for the pouch 10. The system 50 also reduces the risk of spillage and leakage of liquid from the pouch 10.

When the pouch 10 is empty, the user removes the empty pouch from the dock 52 and inserts a fresh, full pouch 10 for use. In this way, the dock 52 is a reusable support for the pouch 10.

In an embodiment, the dock 52 has a height as shown by distance B, a width as shown by distance C, and a depth as shown by distance D. The waist 58 has a height as shown by distance E.

In millimeters, the length of distance B is from two times (2×) to three times (3×) greater than the length of distance C. In an embodiment, B is 200 mm and C is 82 mm.

In millimeters, the length of distance B is from two times (2×) to six times (6×) greater than the length of distance D (depth of dock 52). In an embodiment, distance B is four times (4×) greater than the length of distance D. In a further embodiment, the length of distance B is 200 mm and the length of distance D is 50 mm.

The front panel and rear panel 62, 64 can flex beyond the length of distance D during installation of pouch 10 into the dock 52 or during removal of pouch 10 from the dock 52.

It is specifically intended that the present disclosure not be limited to the embodiments and illustrations contained herein, but include modified forms of those embodiments including portions of the embodiments and combinations of elements of different embodiments as come within the scope of the following claims.

The invention claimed is:

1. A system for dispensing a liquid comprising:

A. a pouch for placement into a dock, the pouch comprising
- (i) a flexible body and a base forming a closed chamber for holding a liquid;
- (ii) a closure for dispensing the liquid, the closure attached to a lower portion of the body;
- (iii) a front flexible film and a rear flexible film, the front flexible film and the rear flexible film sealed around a common peripheral edge; and
- (iv) a first flute and a second flute on opposing sides of the common peripheral edge;

B. a dock comprising
- (i) a floor having a peripheral edge;
- (ii) a waist surrounding the peripheral edge and extending upward from the floor, the waist and the floor defining a seat for receiving the base;
- (iii) a front panel and a rear panel extending upward from opposing sides of the waist, the front panel and the rear panel separated by a gap; and
- (iv) an orifice on a front surface of the waist, the orifice for receiving the closure;
- (v) a first U-shaped edge and a second U-shaped edge on opposing sides of the waist;

wherein an upper end of the front panel stands freely with respect to an upper end of the rear panel; and the first flute contacts the first U-shaped edge and the second flute contacts the second U-shaped edge.

2. The system of claim 1 wherein the dock is a single-piece article composed of a molded polymeric material.

3. The system of claim 1 wherein the rear panel has a shape that is a mirror image of the front panel shape.

4. The system of claim 1 wherein the dock comprises a tapered portion at a lower end of the gap.

5. The system of claim 4 wherein the tapered portion comprises the U-shaped edges.

6. The system of claim 1 wherein the front panel and the rear panel are moveable with respect to each other.

7. The system of claim 1 wherein applying pressure on a panel dispenses liquid from the pouch when the closure is in the open position.

8. The system of claim 1 wherein the base comprises a gusset rim, the gusset rim located in the seat.

9. The system of claim 1 wherein the front flexible film and the rear flexible film of the pouch are sealed around a common peripheral edge to form a flexible body having a closed top and an open bottom;

a base attached to the open bottom of the body, the base and body defining a chamber for holding a liquid;

a hole through a lower portion of the front flexible film;

a closure attached to the hole, the closure comprising
- (i) a collar having a duct in fluid communication with the hole;
- (ii) a housing attached to the collar, the housing having a port in fluid communication with the duct; and
- (iii) a spout pivotally attached to the housing, the spout having a channel through which the liquid is dispensed;

wherein the housing comprises a recess adapted to receive the spout when the closure is in a closed position; a rim of the housing and an outer surface of the spout are coplanar when the closure is in the closed position; and a proximate end of the spout comprises a first pin and a second pin, the pins frictionally engaged with a respective first well and a second well of the housing, the pins and the wells permitting pivotal engagement between the spout and the housing.

10. The system of claim 9 wherein the base comprises a gusset rim, the gusset rim defining a footprint having an ellipsoid shape.

11. The system of claim 9 wherein the closure extends radially outward from the body.

12. The system of claim 9 where the collar is attached to an outer surface of the front film.

13. The system of claim 9 comprising a heat seal around the common peripheral edge.

14. The system of claim 9 wherein the first pin and the second pin are perpendicular to the channel.

15. The system of claim 9 wherein the closure has an open position and a proximate end of the channel is in fluid communication with the port, permitting the liquid to flow through the channel.

16. The system of claim 15 wherein a distal end of the spout extends radially outward from the housing when the closure is in the open position.

17. The system of claim 9 wherein the closure has a closed position and a proximate end of the channel is out of fluid communication with the port, blocking liquid flow from the channel.

18. The system of claim 9 wherein the spout comprises a distal flange.

19. The system of claim 9 wherein the container comprises from 90 wt % to 100 wt % ethylene-based polymer.

* * * * *